US006585078B2

(12) United States Patent
Curtice et al.

(10) Patent No.: US 6,585,078 B2
(45) Date of Patent: Jul. 1, 2003

(54) MUFFLER INSERT

(75) Inventors: Morgan M. Curtice, Bloomfield, NY (US); Gary D Latimer, Holley, NY (US)

(73) Assignee: Race Tools, Inc., Rochester, NY (US)

( * ) Notice: Subject to any disclaimer, the term of this patent is extended or adjusted under 35 U.S.C. 154(b) by 0 days.

(21) Appl. No.: 09/748,524

(22) Filed: Dec. 22, 2000

(65) Prior Publication Data

US 2002/0079161 A1 Jun. 27, 2002

(51) Int. Cl.[7] ..... F01N 1/10
(52) U.S. Cl. ..... 181/252; 181/256; 181/243
(58) Field of Search ..... 181/252, 256, 181/258, 243, 282; 29/890.08

(56) References Cited

U.S. PATENT DOCUMENTS 4,421,202 A * 12/1983 Hoy ..... 181/252
4,947,957 A * 8/1990 Cullen et al. ..... 181/258
5,705,777 A * 1/1998 Flanigan et al. ..... 181/252
6,053,276 A * 4/2000 D'Amico, Jr. et al. ..... 181/243
6,241,043 B1 * 6/2001 Goertz ..... 181/252

* cited by examiner

*Primary Examiner*—Khanh Dang
(74) *Attorney, Agent, or Firm*—Stephen B. Salai, Esq.; Roger Aceto, Esq.; Harter, Secrest & Emery LLP

(57) ABSTRACT

An insert assembly for a muffler of a high-performance motor cycle, having an insert with a filling of compressed heat-resistant, sound-absorbing material mounted on a removable hollow tube having an inside diameter greater than the outside diameter of the perforated core of the muffler. The filling includes a bulked-up continuous filamentary material. Once the insert has been introduced into the muffler by sliding the tube along the core, the tube is then withdrawn leaving the insert behind in the muffler. Removal of the tube allows the filling to relax towards its intended density. The first subsequent exposure to hot exhaust gases causes certain portions of the insert to degrade, allowing further relaxation of the filling to assume its intended density. Further, the tube precludes potential damage to the insert during its introduction into the muffler.

24 Claims, 9 Drawing Sheets

MUFFLER INSERT

FIELD OF THE INVENTION:

This invention relates generally to high performance mufflers and more particularly to a muffler insert assembly for an exhaust system of an internal combustion engine, in particular a motorcycle engine.

BACKGROUND OF THE INVENTION:

While most mufflers used on passenger cars and light trucks are not serviceable items, that is they are not designed to be refurbished after a period of use, high performance mufflers and especially high performance mufflers for motor cycles, such as racing motor cycles are made from durable components that hold renewable sound absorbing materials that can be replaced after a period of use. Typically, a high performance racing motor cycle muffler includes a housing such as a generally cylindrical or other tubular housing. An exhaust pipe extends from the engine through the housing and terminates at an exhaust port, forming a generally co-axial structure with the housing. The portion of the exhaust pipe within the housing is a perforated core. A sound absorbing material or a series of baffles is disposed between the core and the housing to reduce engine noise. Fiberglass batting is well suited to this application and is commonly used.

After a period of use, the fiberglass sound absorbing material in a high performance muffler becomes compressed and loses its effectiveness. This both increases the noise created by the engine, and changes the operating characteristics of the engine due to changes in back pressure and the like. Because the housing and the core are more durable and have a longer lifetime than the fiberglass sound absorbing material, it is desirable to rebuild mufflers of the type just described by replacing the sound absorbing material. While the methods used for manufacturing new mufflers could theoretically be used to replace the sound absorbing material in a used muffler, such methods normally employ special tools that are either too expensive and/or not generally available for performing occasional rebuilds.

A number of methods for rebuilding mufflers have been proposed. Releasing porous sound absorbing material from a container into the muffler is one such method. This method has a number of disadvantages including inaccurate control over the amount of the material inserted, and the non-uniformity of filling. In addition, such materials have a short life. German Patent No. DE G 89 10 785 discloses a cylindrical muffler insert element made from an inner and an outer screen pipe with a filled in intermediate space. This is expensive to produce, transport, store and assemble. In addition, the insert seats imprecisely in the muffler, which is another disadvantage.

More recently, a composite insert shaped in the form of a hose has been proposed. The shaped composite can be formed by sewing strips formed of flat materials into which sound absorbing material can be inserted, and the covering sewn together. This construction is an advantage over some of the other known constructions, but has its own disadvantages. Specifically, unless the inner covering is quite durable, it may catch on the perforations in the core of the muffler during installation, and allow the sound absorbing material to shift undesirably.

In prior art which is the subject of a U.S. patent application (serial number unknown), muffler inserts are described which are formed from a predetermined amount of loosely bundled individual elements of a sound absorbing material, the loose bundle being confined roughly in an assembly shaping unit intended for insertion in the muffler. The loose bundle is fixed corresponding to the assembly shaping unit to a shape composite such that the fixed shape can be handled without individual elements loosening until assembly for the specific uses of the muffler insert. However, during the specified uses of the muffler insert the filling is at least partially released. Advantageously, the insert is released by the action of high temperature in the muffler. These can lead to the release of adhesive bonds, seams or the like and thus cause the at least partial release of the shaped composite.

BRIEF DESCRIPTION OF THE INVENTION

It is an object of this invention to provide a muffler insert for replacing fiberglass or otherwise compressible sound absorbing material that allows the material to expand within the muffler without the need for heating the muffler to release a seal.

It is another object of this invention to provide a muffler insert that has sufficient stiffness prior to insertion that it is easy to package and ship.

Is another object of this invention to provide a method for refilling a muffler including at least the steps of compressing a sound absorbing material to form a muffler insert, inserting the insert into a muffler to be rebuilt and at least partly uncompressing the material without the need for the application of heat.

Briefly stated and in accordance with a presently preferred embodiment of the invention, a muffler insert assembly for a motor vehicle exhaust of the type including a perforated core, a housing generally coaxial with the core and a layer of tufted sound absorbing material disposed between the core and the housing includes a rigid hollow inner tube with inner dimensions exceeding the outside dimensions of the perforated core, a flexible retaining layer wrapped around the inner tube and slidably retained thereon, a flexible outer wrap overlying the retaining layer and stitched thereto around the border thereof to form a fillable space there between, and a fibrous filling compressed in the fillable space so that the inner tube can be translated along the pipe until it passes into a muffler casing and removed, releasing the fibrous filling to expand into the space previously occupied by the inner tube.

A method of refilling a muffler of the type that includes a housing and a perforated muffler core within the housing includes the steps of providing a rigid inner tube having an inside diameter greater than an outside diameter of the muffler core, forming a muffler insert having a layer of compressed sound absorbing material around the inner tube, sliding the inner tube and the layer of compressed sound absorbing material over the muffler core and removing the rigid insert core and allowing the compressed sound absorbing material to expand against the muffler core.

The novel aspects of the invention are set forth with particularity in the appended claims. The invention itself together with further objects and advantages thereof may be more readily understood by reference to the following detailed description of a presently preferred embodiment of the invention taken in conjunction with the accompanying drawing in which:

Figure 1:
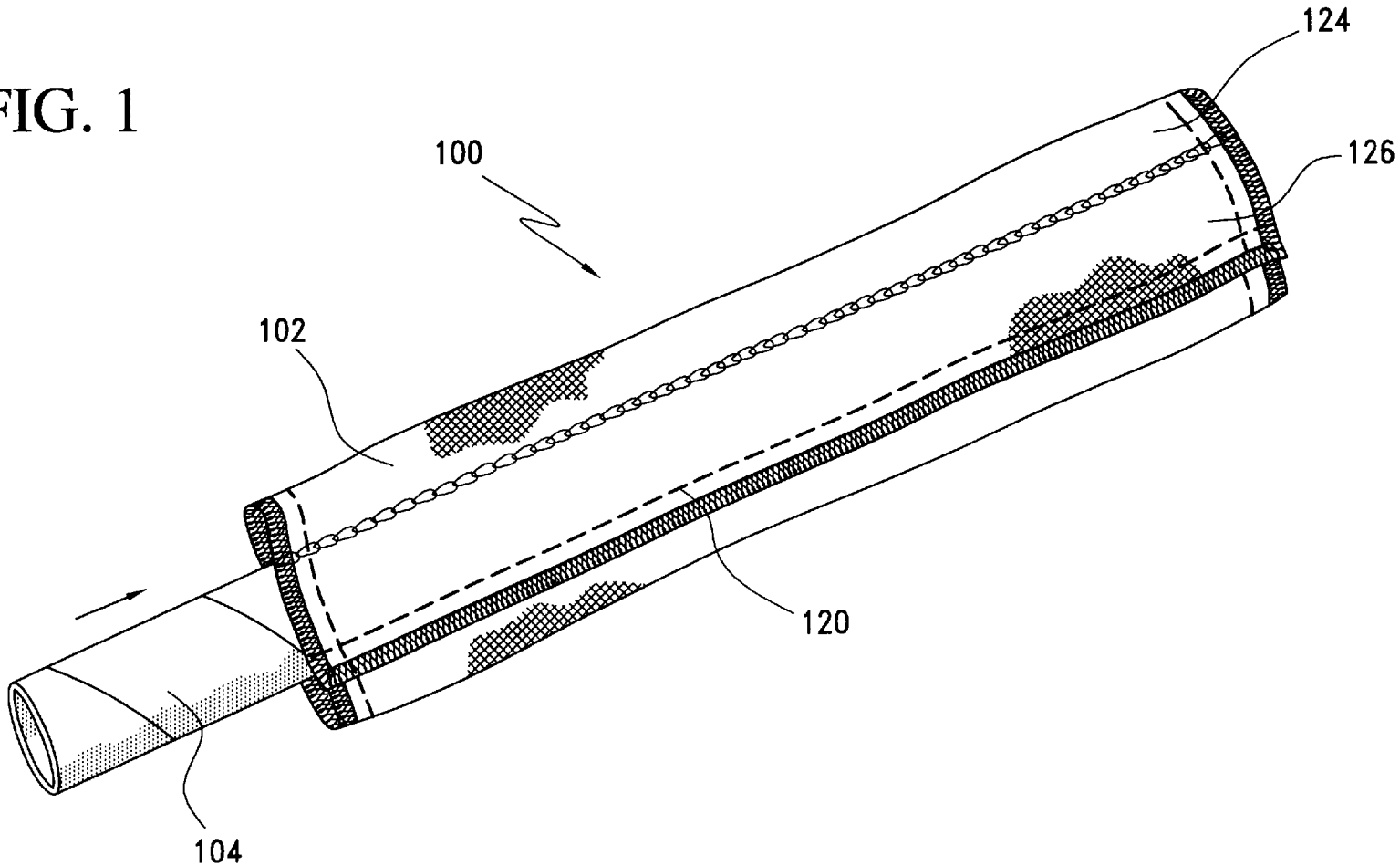
FIG. 1 is a perspective view of an insert assembly including an insert for a muffler of an internal combustion engine exhaust system.

DETAILED DESCRIPTION OF THE INVENTION:

Referring now to FIG. 1, this shows an insert assembly 100 of the present invention including a flexible muffler insert 102, which is intended in for a user of a vehicle and particularly of a high performance motorcycle to replace an existing filling in a muffler 152. Such a user can normally dismantle the muffler 152 and discard an old filling, which will have deteriorated with use.

Figure 2:
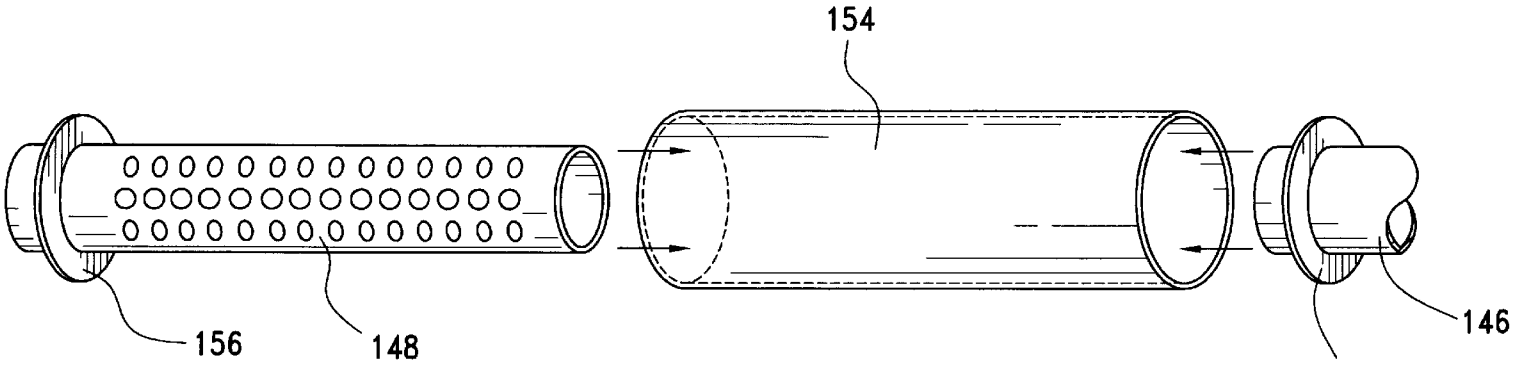
FIG. 2 is a schematic exploded view of elements of the exhaust system.
Figure 3:
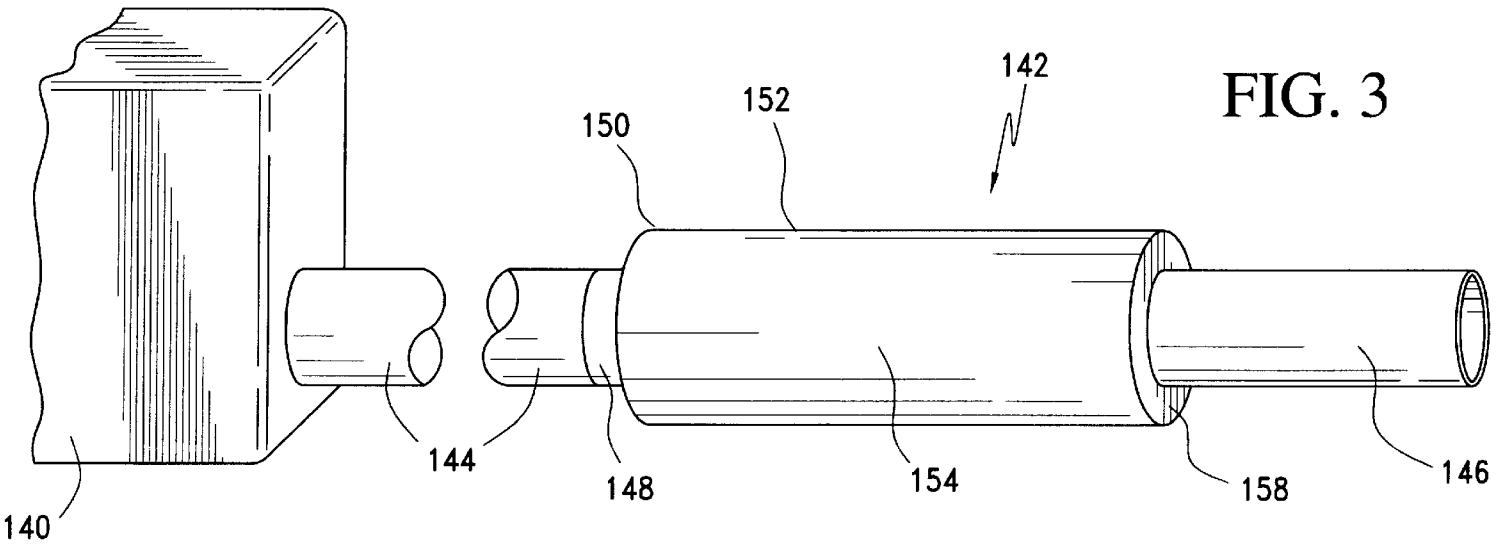
FIG. 3 is a schematic perspective view of the exhaust system.

As shown particularly in FIGS. 2, and 3, the muffler 152 is part of an exhaust system 142 for an internal combustion engine 140. The muffler 152 includes a perforated core 148 and a housing 150, which includes a casing 154, a leading end 156 and a removable trailing end 158. The cross-sections of the core 148 and the casing 154 are typically circular but may have other, for example elliptical, shapes. Normally, the leading end 156 is permanently welded both to the core 148 and to the casing 154. The core 148 effectively extends along the entire length of the housing 150, and additionally extends a short distance outside the leading end 156 to provide a portion which can be joined to an exhaust pipe 144 which extends from the engine 140. At the rear of the muffler 152 the trailing end 158 has welded to it a tailpipe 146 that removably engages the core 148 just within the housing 150. Generally, the core 148 and the exhaust pipe 144 or tailpipe 146 are sized and shaped near the appropriate joint to provide a snug fit. The joint between the exhaust pipe 144 and the core 148 may be secured with a clamp. The joint between the tailpipe 146 and the core 146 is internal to the housing and is secured by fastening the trailing end 158 to the casing 154 by means such as bolts. The attachment of the core 148 to the exhaust pipe 144 or tailpipe 146 is well known in the art and requires no further detail. Similarly, attachment means of the exhaust pipe 144 and the muffler 152 to the vehicle are also well known in the art and will not be described.

Figure 5:
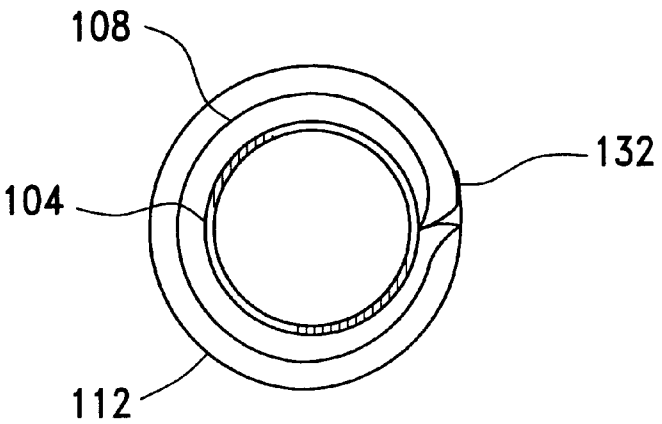
FIG. 5 is an end view schematically showing the insert completely wrapped around the tube to form the insert assembly.
Figure 4:
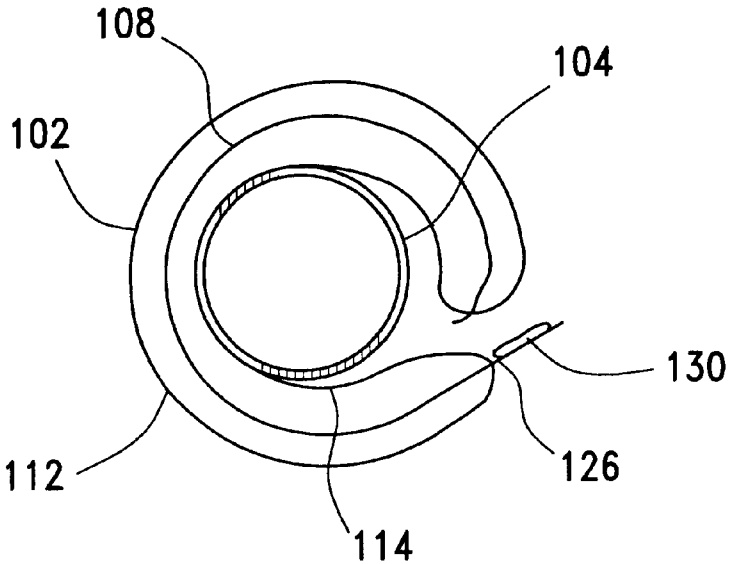
FIG. 4 is an end view schematically showing the insert in the process of being wrapped around a tube.

The insert assembly 100 includes a removable inner tube 104, around which the flexible muffler insert 102 is completely wrapped, as seen in FIGS. 4 and 5. The tube 104 is rigid or semi-rigid to the extent that it can maintain its shape under any contemplated compression forces exerted on it by the insert 102. The tube 104 is typically fabricated from cardboard, but can be of plastic, metal or other inexpensive material which provides the required resistance to compression. It is contemplated that the tube 104 will have an inside diameter slightly greater than the outside diameter of the core 148, and that it will be at least as long as the insert. The tube 104 provides enough support to the insert 102 to facilitate its being passed over the core 148, while at the same time holding a filling 116 of the insert 102 under some compression. As will be described, once the tube 104 has fulfilled its function of assisting the installation of the insert 102 into the muffler 152, it is then easily removed by the user, leaving just the insert 102 around the core 148.

Figure 6:
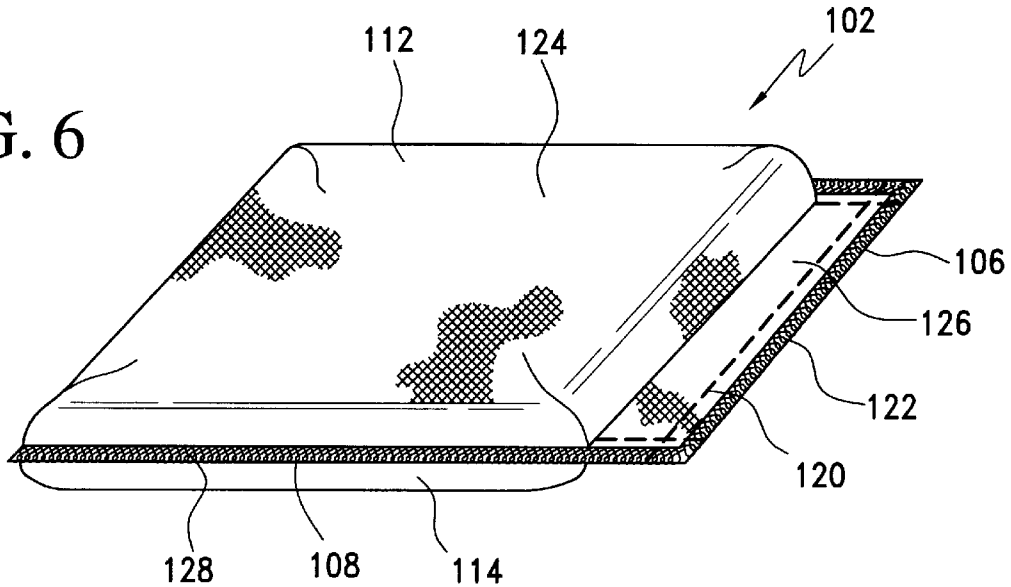
FIG. 6 is a schematic perspective view of the insert prior to being formed around the rigid tube.
Figure 7:
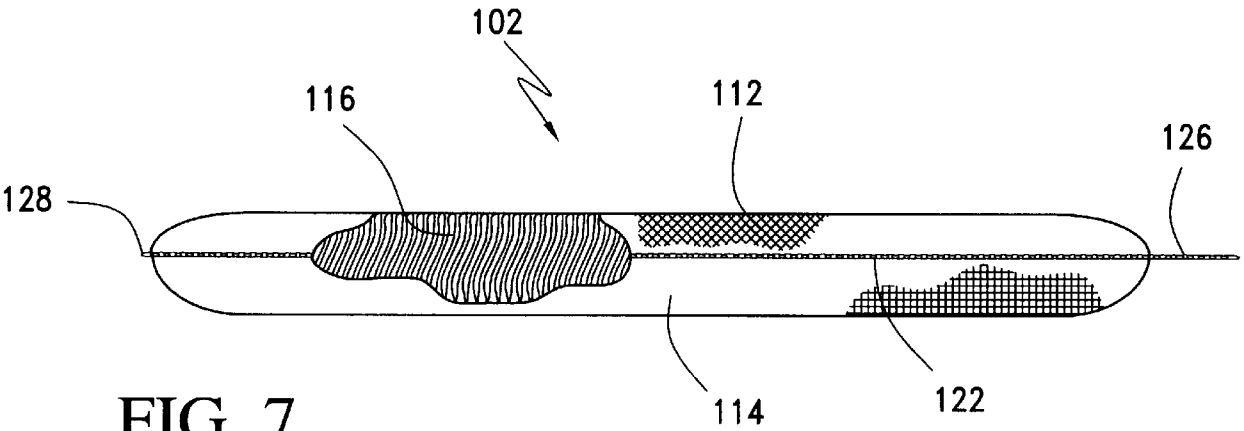
FIG. 7 is a is a schematic side view of the insert of FIG. 6, with a cutaway portion showing the filling.

Prior to being wound around the tube 104, the insert 102 is generally pillow-shaped, having longitudinal edges 106 and lateral edges 108 as seen in FIGS. 6 and 7. In this context, the term "longitudinal" is defined by the direction of the tube 104 in the completed assembly 100. Consequently, the lateral edges 108 are the edges which, once the insert 102 is wound around the tube 104, are generally concentric therewith.

Figure 8:
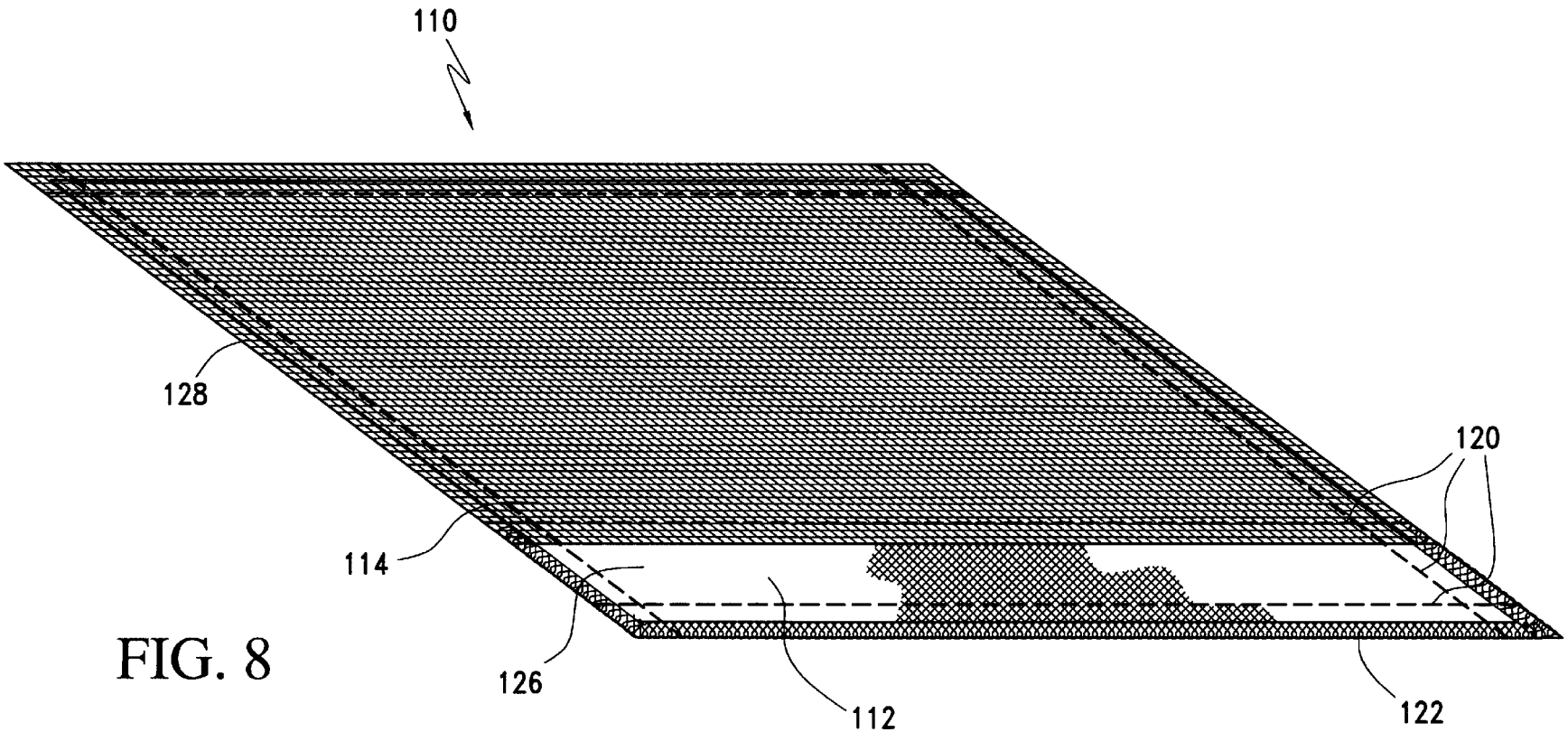
FIG. 8 is a perspective view of an envelope for the insert.

As shown in FIG. 8, an envelope 110 for the insert 102 is formed from a first layer or wrap 112 of flexible fabric and a second or retaining layer 114 having a net-like form. The envelope 110 contains the filling 116 which is a heat-resistant sound-absorbing material 118. The filling 116 is in a somewhat compressed condition. As will be discussed later, the selected degree of compression allows the insert 102 to be handled easily at all stages through its complete introduction into the muffler 152, and then provides that the filling 116 can relax after installation to an optimum density.

The wrap 112 is a rectangular piece of fabric, preferably a durable, heat-resisting densely woven fiberglass such as is supplied by Lewco Specialty Products under the number 1332AB; this is an E-glass fabric with a designated weight of 9 oz/yard, which is more correctly 9 oz/square yard. The fabric has a crowfoot weave and an acrylic coating whose primary purpose is to inhibit fraying. Other possible fabrics might be made from durable materials such as graphite or metals. It is preferred that the while material of the wrap 112 be flexible, it should not have significant elasticity. Although other weaves may be selected, the crowfoot weave is strong and inelastic enough to resist catching while being moved near external protruding surfaces, so that any catch which does occur is easily released rather than being maintained and increasingly stressed.

The filling 116 is preferably a fibrous material such as a bulked-up continuous heat-resistant yarn or roving. A variety of vitreous, ceramic or metallic materials could be employed. In particular, the yarn or roving is fiberglass, preferably E-glass, which combines the required durability with reasonable cost. Its flexibility and resistance to brittle fracture is desirable for packing and compression into the envelope 110 as described later.

The retaining layer 114 is preferably a rectangular piece of netting having a longitudinal dimension similar to that of the wrap 112, and a lateral dimension somewhat smaller than the lateral dimension of the wrap 112. The retaining layer 114 is disposed atop the wrap so that one longitudinal edge and both lateral edges align with the corresponding edges of the wrap 112. To correspond with commonly used mufflers, the dimensions of the wrap 112 are typically 12"×8.5" and of the retaining layer 114 typically 12"×7". The retaining layer 114 is selected to be degradable when exposed to hot exhaust gases. It is preferably made from a woven E-glass material known as scrim, which is a mesh with openings about 0.1" across and an open area of about 90%. While the E-glass is durable when used for the wrap 112 and the filling 116, as the material of the retaining layer it is quickly degraded by hot exhaust gases, largely because its lateral yarns are under tension and undergo brittle fracture. However, the retaining layer could be woven from any other material such as a synthetic polymer or natural yarn selected to be degradable by hot exhaust gases.

To assemble the insert 102, first the retaining layer 114, near all of its borders, is stitched to the wrap 112 with a stitch preferably of the type known as a safety stitch 120. The safety stitch 120 continues also to include portions near the wrap edges which are not shared with the retaining layer 114. Simultaneously, a stitch preferably of the type known as a serge or overlock stitch 122 is applied around all edges of the wrap 112. The safety stitch 120 provides the strength to hold the layers together, while the overlock stitch 122 protects the wrap 112 from fraying. The thread used for stitching is normally polyester, but could be any synthetic polymer or natural yarn which would degrade when exposed to hot exhaust gases. Alternative means to stitching may be employed to bond the layers together and preclude the occurrence of fraying. For example, adhesives may be applied both for binding and to preclude fraying. Alternatively, when both the wrap 112 and retaining layer 114 are fusible, brief local heating may be applied locally to bond them top each other and to fuse together warp and weft yarns around the border of the wrap 112.

The scrim of the retaining layer 114 is an inexpensive material, which is sufficiently strong to hold the filling 116 during manufacture but requires no significant strength once the insert assembly 100 has been put into use.

Figure 9:
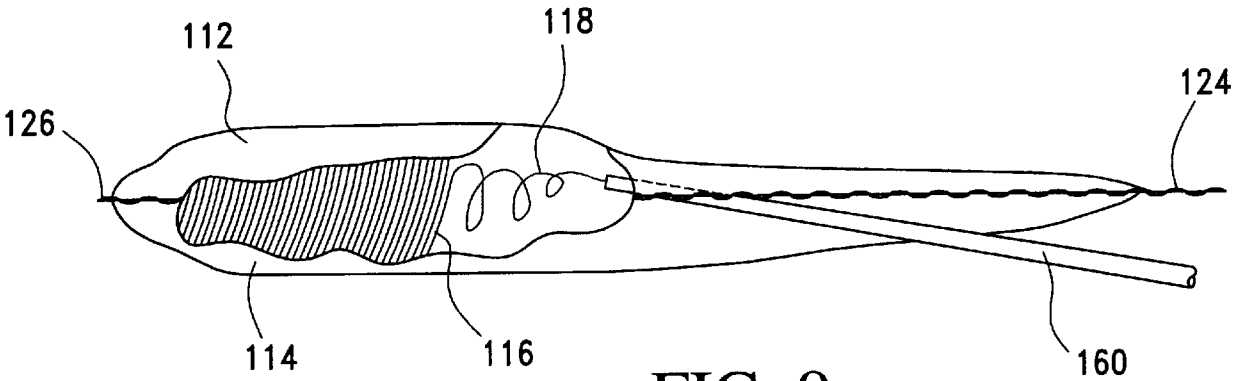
FIG. 9 is a schematic showing the envelope partially cut away to demonstrate the introduction of a filling into the envelope.

As stated earlier, the preferred filling material is a bulked-up continuous E-glass yarn or roving. In this context, the term "continuous" is understood to refer to the general characteristic of the material, even though a given filling may contain a plurality of continuous fibers or filaments. The bulking process agitates the yarn, displacing individual strands to produce a textured fleece-like filament. The introduction of the filling 116 into the envelope 110 is shown schematically in FIG. 9. The safety stitch 120 is severed at a selected point along a common edge of the wrap 112 and the retaining layer 114 to permit a filling tool such as a nozzle 160 to be introduced between them. The continuous filament is blown in by the nozzle. The incoming fiber can be directed by the nozzle so that it efficiently fills the space between the layers 112 and 114, including the corners. The resultant filling 116 has a reasonably uniform thickness and packs to the desired extent between the layers 112 and 114. The completed filling 116 is somewhat compressed without excessively stressing the scrim of the retaining layer 114 which has a relatively low strength. The result is a pillow typically approaching a thickness of 2" (50 mm).

The introduction of the filament into the envelope 110 is controllable. While the method of introduction is not a part of this invention, it can be noted that the direction and feed rate of the incoming filament can be varied to provide that the resultant filling 116 has a preselected density gradient. Therefore, the filling 116 can be denser at one end of the insert than the other, and in particular it can be denser near the leading end 156 of the housing 150 where it is exposed to the hotter exhaust gases than elsewhere in the muffler 152. A particular density gradient may be selected in trading off somewhat lower sound attenuation against an increased projected longevity of the insert.

Immediately after being filled, the insert 102 has a generally rectangular shape, having a pillow portion 124, a major margin 126 along one of the longitudinal edges 106 of the pillow portion 124, and a minor margin 128 along each of the three remaining edges of the pillow portion 124. The margins represent the area of the insert 102 outside that enclosed by the safety stitches 120. Additionally, the major margin 126 provides an area which intentionally extends beyond the pillow portion 124.

The insert 102 is wound around the rigid tube 104 which normally acts as a mandrel. Optionally, an actual mandrel 170 can be inserted into the tube 104 to aid in making up the insert assembly 100. The mandrel 170 can be fabricated from any rigid material such as metal, wood or hard plastic.

To construct the assembly 100, the tube is positioned against the retaining layer of the pillow portion 124, and acts as a form around which the insert 102 is wrapped to compress the filling 116 between the tube 104 and the wrap 112. The tube 104 and the insert 102 are sized so that when the insert 102 is wrapped around the tube 104, the inside surface of the major margin 126 can substantially overlap the outside surface of the wrap 112 where opposing portions of the insert 102 meet. The surfaces are bonded together in this configuration by an adhesive 130 which provides a heat-releasable seal 132. The insert 102 is shown in FIG. 4 incompletely encircling the tube 104, and in FIG. 5 after having been sealed around the tube 104. The compression of the insert 102 as it is wrapped around the tube 104 is particularly evident in FIG. 4. Typically, a low-melting point hot-melt glue, such as is obtainable under the trade name Adtech 610, is applied where the two surfaces meet. The glue is selected so that it only hardens slowly when first applied, but sets up rapidly when the surfaces are compressed together. As applied, the glue is sufficiently fluid and wets the fabric well enough so that it easily permeates into the fabric. The seal 132 may also be formed from any other attachment means that releases when heated, such as stitches or staples formed from a heat-degradable material. Alternatively, the insert could be secured in its wrapped position by an exterior thread or cord of heat-degradable material which is wound and tied therearound.

Figure 11:
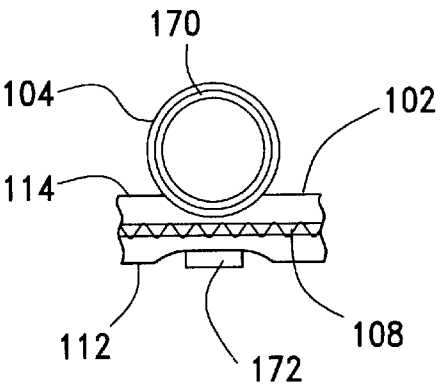
FIG. 11 is a schematic end view of the tube and mandrel assembly showing a portion of the filled envelope prior to formation of the insert.
Figure 10:
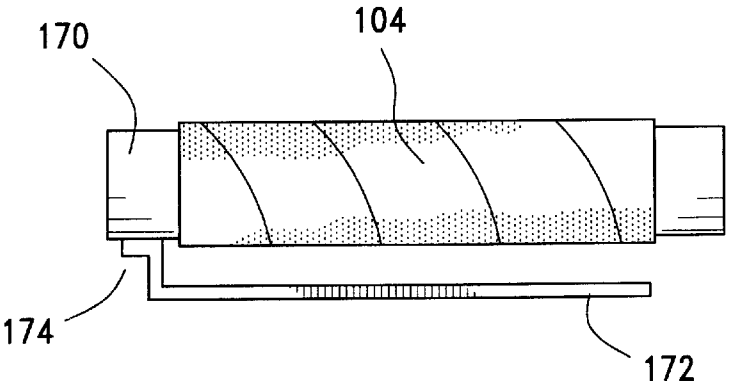
FIG. 10 is a schematic side view of the tube and a mandrel assembly engaged therewith.
Figure 13:
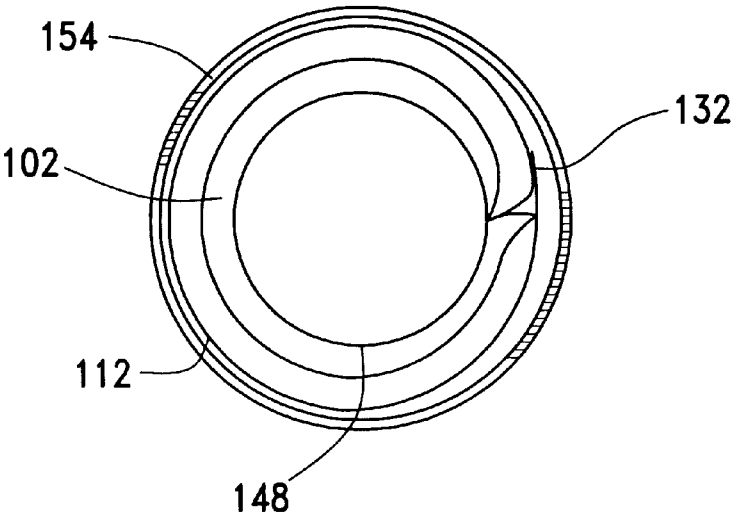
FIGS. 12 and 13 are schematic cross-sectional end views showing selected successive steps of introducing the insert into the muffler.
Figure 12:
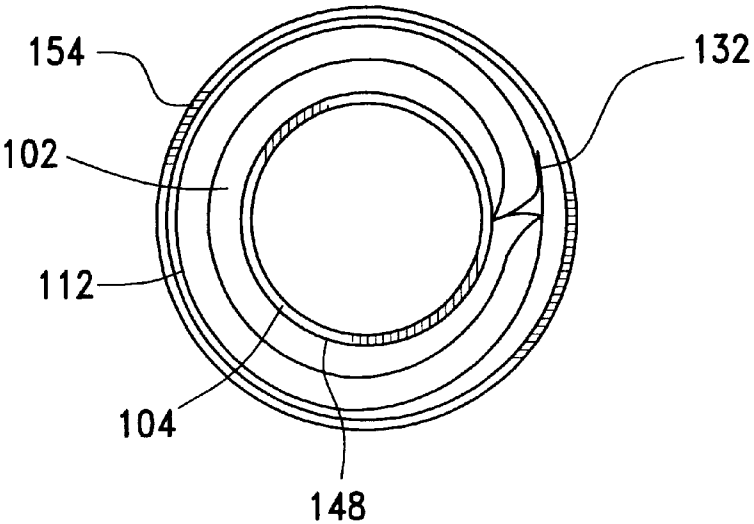
Figure 14:
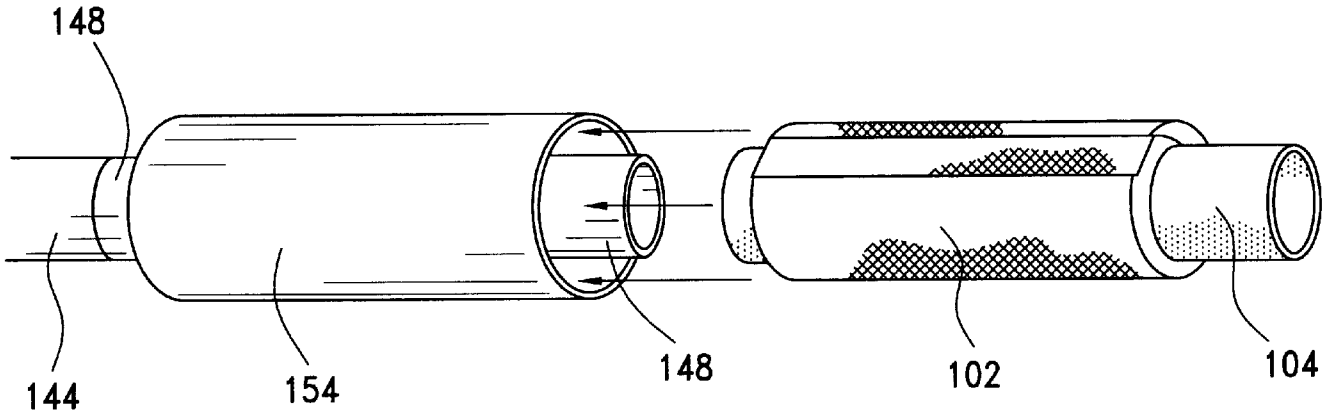
FIGS. 14, 15, 16 and 17 are schematic perspective views showing successive steps of introducing the insert into the muffler and restoring the exhaust system to a usable condition.
Figure 15:
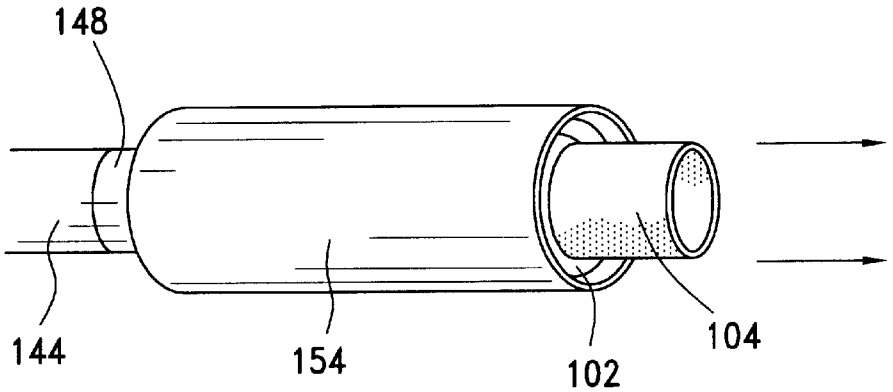
Figure 16:
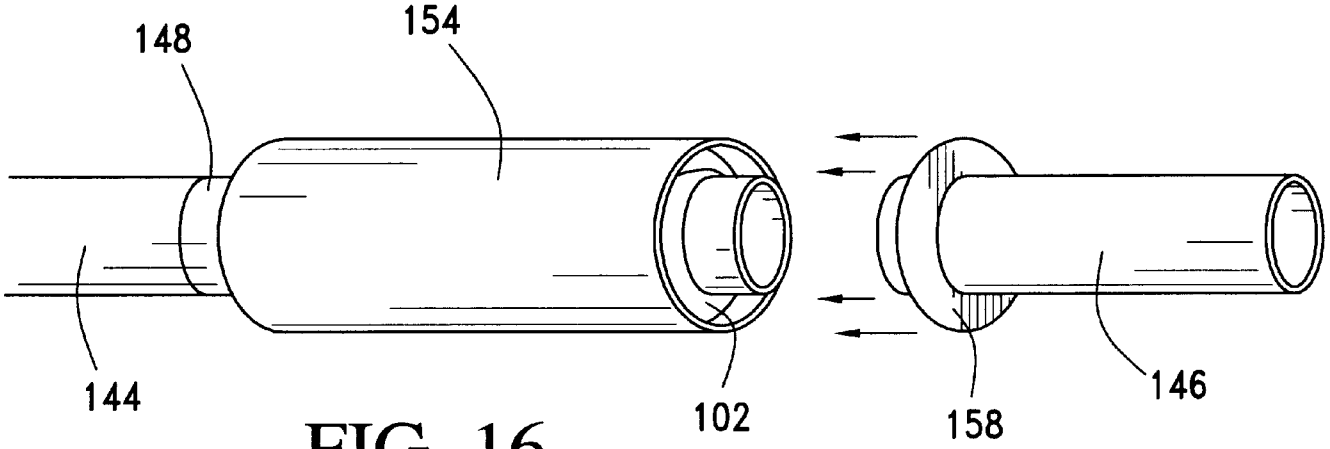
Figure 17:
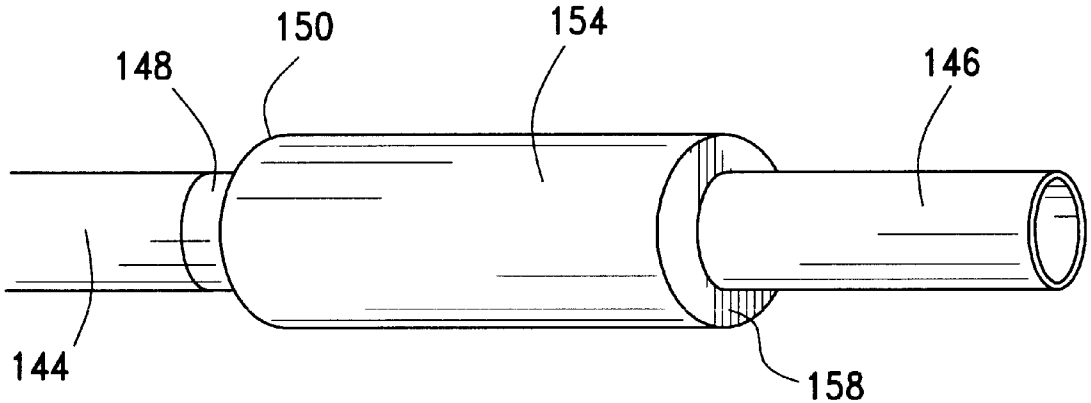

When the optional mandrel 170 is used, it is typically equipped with a longitudinal strip 172 joined at one end to form a mandrel assembly 174 as shown in FIG. 10. The strip 172 and the mandrel 170 can be of the same or different materials. Except at their point of attachment, the strip 172 and the mandrel 170 are spaced far enough apart to accommodate both the tube 104 and the insert 102 with some slight compression of the pillow portion 124 as indicated in FIG. 11. Compared with manual handling, the mandrel assembly 174 provides a more convenient means of holding the pillow portion 124 in position while the insert is wrapped around the tube 104.

In the insert assembly 100, then, the insert 102 is disposed around the tube 104 so that only the retaining layer 114 and exposed portions of the filling 116 contact the tube 104. As will be described, one function of the tube 104 is to assist in the installation of the insert 102 into the muffler 152, but is easily removable once this function has been fulfilled.

The introduction of the insert 102 into the muffler 152 and the reassembly of the exhaust system 142 is shown schematically in FIGS. 12 through 17. The tube 104 is slid freely along the core 148 until the insert 102 is completely inside the casing 154. The insert 102 is sized so that when inserted into the muffler 152, with the filling 116 compressed relative to its final state, it encounters no significant interference from the casing 154. Once the insert 102 has been fully inserted into the muffler 152, the tube 104 is withdrawn leaving the insert 102 in place. As particularly evident from FIGS. 12 and 13, the withdrawal of the tube 104 allows the filling 116 to expand and fill the space previously occupied by the tube 104, whose wall thickness is typically about 0.1" (2.5 mm). Neglecting the insignificant volume of the retaining layer 114, the filling 116 is now effectively in contact with the core 148. In other words, the filling 116 is at least partly expanded when the muffler 152 is first rebuilt, without requiring that the muffler 152 reach a predetermined temperature for releasing any seam, adhesive bond, or the like. The muffler 152 is then reassembled.

One purpose of the rigid tube 104 is to allow the insert 102 to be freely translated along the core 148. Typically, the core 148 is not smooth, especially since there is often a burr where the perforations pass through the wall. Without the presence of the tube 104, the "free" opening at the center of the insert 102 would be insufficient to accommodate the core 148 without causing damage to the retaining layer 114 and filling 116 during installation.

It is intended that when first inserted, the insert 102 has a small enough outside diameter to allow some play relative to the inside of the casing 154. Nevertheless, the wrap 112 may rub against the inside of the casing 154 during insertion, and the strength of the wrap 112 serves to protect the insert 102 from significant damage by the casing 154 and particularly by any inwardly protruding surfaces, such as rivets commonly used to attach a nameplate to the housing 150.

With the next use of the engine, the insert 102 is exposed to exhaust gases passing through the muffler 152 at temperatures ranging from 400 to 1240 ° F. (200 to 650° C.). The adhesive 130 of the seal 132 melts, and all organic materials including also the binder and the thread, begin to degrade at 500–600 ° F. (260–320° C.); the organics are completely burned off by about 900° F. (480 ° C.). The scrim, having low durability, also degrades. As a result, the insert 102 unwinds until the wrap 112 conforms with the inside of the casing 154, and the filling 116 relaxes further to effectively fill all the available space between the core 148 and the casing 154, thus increasing its ability to attenuate sound.

Although the wrap 112 retains its integrity, it takes up only an insignificant volume and does not interfere with the functioning of the muffler 152. Contact of the wrap 112 against the casing 154 is especially desirable if the casing 154 is a carbon fiber rather than a metallic product. The durable wrap 112 protects the carbon from direct exposure to the hot exhaust gases which could otherwise promote its degradation. The scrim of the retaining layer 114 degrades significantly during the first post-installation heat cycle. Once the retaining layer and associated stitching is degraded, any of the filling 116 near the safety stitches 120 which was previously precluded from relaxing is now free to expand and fill any remaining space adjacent the core 148. This further increases its ability to attenuate sound.

The optimum density of the filling 116 in an operating muffler is in the range 200–400 grams/liter, preferably about 300 grams/liter. If the density of the filling were too low, exhaust gases would too easily pass from the core 148 into the filling 116 and cause excessive turbulence which would disturb the filling 116. On the other hand, if the density were too high, the muffler 152 would be overfilled and would be ineffective in reducing noise; the effect would be conceptually similar to the core having a solid wall instead of being perforated. If the filling 116 has a density gradient, the density at any point should nevertheless remain within the preferred range 200–400 grams/liter, and the preferred average density should remain at about 300 grams/liter. Furthermore, it is understood that at any point in the relaxed filling, the density is less than at the same point when the filling is compressed.

Some appreciation of the expansion of the filling between the insert being placed into the muffler housing and attaining its most relaxed state can be gained from the following example. In a particular muffler and the insert intended for use therewith, the inside diameter of the casing 154 is 3.3" (84 mm), the outside diameter of the insert 102 in its compressed state around the tube 104 is 3.0" (76 mm), the outside diameter of the tube 104 is 2.2" (56 mm), and the outside diameter of the core 148 is 2.0" (51 mm). Since the expansion of the filling 116 is almost exclusively radial, and neglecting as insignificant the volume occupied by the wrap 112 and retaining layer 114, it is readily calculated, then, that the filling expands in total by a factor of about 1.65. The expansion allowed by withdrawing the tube only, i.e., before the seal 132 is degraded by the hot exhaust gases, is about 1.2.

The insert assembly 100 can be configured to fit different sizes and shapes of muffler. Since the insert 102 is flexible and compressible, a given insert can be used with different mufflers, including mufflers having modest differences in length or different shapes; mufflers may be circular or elliptical in cross-section, and may have tapered portions. A properly sized insert can function in any of these circumstances, provided that it has an amount of filler appropriate to packing the available volume, it being remembered that once the insert 102 has been exposed to hot exhaust gases, there remains no glue or stitching to confine the filling 116 to a smaller volume.

In a second embodiment of the invention, the wrap 112 and the retaining layer 114 can be heat-degradable. For example, both layers could be made from such materials as cellophane, various plastics, paper or other materials. They could be bonded by adhesive or heat-sealing. The retaining layer 114 would be perforated in order to permit air to escape during those stages of manufacturing the insert 102 subsequent to sealing the wrap 112 and the retaining layer 114 together. Regardless of its composition, the material especially of the wrap 112 would have to resist catching or tearing. The second embodiment might be contemplated for use in mufflers that are not at the top end of high-performance mufflers and in which it is less critical to protect the inside of the casing.

In summary, then, the insert assembly 100 is constructed so that the tube 102 allows the filling 116 to be delivered into the muffler 152 in a compressed state, and further so that the removal of the tube 102 allows the filling 116 to relax to a density approaching its intended density. Finally, hot exhaust gases degrade portions of the insert 102 such as the safety stitches 120, the seal 132 and the retaining layer 114, thus allowing the filling 116 to further relax and assume its intended density.

While the invention has been described in connection with the presently preferred embodiment thereof, those skilled in the art will recognize that many modifications and changes may be therein without departing from the true spirit and scope of the invention which accordingly is intended to be defined solely by the appended claims:

I claim:

1. An insert assembly for a motor vehicle exhaust muffler of the type including a perforated core and a housing generally co-axial, comprising:

(a) a hollow tube with inner dimensions exceeding the outside dimensions of a perforated core;

(b) a retaining layer wrapped around the tube and slidably retained thereon;

(c) a wrap layer overlaying the retaining layer and stitched thereto around the border thereof; and (d) a fibrous filling compressed between the wrap layer and the retaining layer to a density greater than that contemplated when the filling is in use;

so that the tube can be translated along the core until it passes into a muffler casing.

2. The assembly of claim 1, wherein the filling is configured in continuous filamentary form.

3. The assembly of claim 2, wherein the filling comprises a bulked up filament.

4. The assembly of claim 1, wherein the compressed filling can relax to at least 120% of its original volume when the tube is removed from the remainder of the assembly.

5. The assembly of claim 1, wherein the tube can maintain its shape under any contemplated compression forces exerted by the insert.

6. The assembly of claim 1, wherein the wrap layer is secured around the tube with a seal.

7. The assembly of claim 6, wherein the seal is heat degradable.

8. The assembly of claim 6, wherein the compressed filling can relax within the housing to at least 165% of its original volume when the seal is degraded.

9. The assembly of claim 1, wherein the filling has a preselected density gradient, each point of the filling being compressed to a density greater than contemplated for that point when the filling is in use.

10. The assembly of claim 1, wherein the filling has a preselected density gradient, each point of the filling being compressed to a density greater than contemplated for that point when the filling is in use, the density of the filling generally decreasing as its intended distance from a leading end of the housing increases.

11. The insert assembly of claim 1, wherein the filling is glass fiber.

12. The insert assembly of claim 1, wherein the filling is E-glass fiber.

13. The insert assembly of claim 1, wherein the filling is textured fiber.

14. The insert assembly of claim 1, wherein the wrap layer is an E-glass fabric.

15. An insert assembly for a motor vehicle exhaust muffler of the type including a perforated core and a housing generally co-axial and surrounding the core, comprising:

(a) a removable hollow tube with inner dimensions exceeding the outside dimensions of the perforated core;

(b) a muffler insert surrounding the tube and slidably retained thereon, the insert having a filling of sound absorbing material compressed against the hollow tube to a density greater than contemplated when the insert is in use;

so that the tube can be translated along the core until the tube and the insert pass into the muffler housing and the tube thereafter being removable from the core and the muffler housing while maintaining the insert within the muffler housing.

16. The assembly of claim 15, wherein the filling is configured in continuous filamentary form.

17. A method of refilling a muffler of the type including a housing and a muffler core within the housing, comprising the steps of:

(a) providing a rigid tube having an inside diameter greater than an outside diameter of the muffler core;

(b) forming a muffler insert having a filling of sound absorbing material;

(c) wrapping the insert around the tube to compress the filling to a density greater than contemplated when the material is in use;

(d) sliding the tube and filling over the muffler core; and (e) removing the tube and allowing the filling to expand against the muffler core.

18. The method of claim 17 in which the step of forming a muffler insert comprises forming a wrap layer surrounding the filling.

19. The method of claim 18 comprising securing the wrap layer around the filling with a heat degradable seal.

20. The method of claim 19 comprising heating the heat degradable seal to release the seal and cause filling to expand within the housing.

21. A method of refilling a muffler of the type including a housing and a muffler core within the housing, comprising the steps of:

(a) forming an envelope by stitching together a wrap layer and a retaining layer;

(b) introducing into the envelope a filling of a heat resisting, sound absorbing material configured in continuous filamentary form;

(c) forming a muffler insert by wrapping the filled envelope around a tube, the tube having an inside diameter greater than the outside diameter of the core, and retaining the insert around the tube with a heat-degradable seal, so that the filling is compressed to a density greater than contemplated when the insert is in use;

(d) slidingly engaging the tube and the core until the insert is contained within the housing; and (e) withdrawing the tube from the insert, thus allowing the filling to expand against the core.

22. The method of claim 21, comprising also the step of providing that the filling has a preselected density gradient.

23. The method of claim 21, comprising also the step of providing that the filling has a preselected density gradient, the density decreasing with increasing distance from a leading end of the muffler.

24. The method of claim 21, comprising heating the heat degradable seal to release the seal and allow the filling to further expand within the housing.

* * * * *